US007966967B2

(12) United States Patent
Sakakibara et al.

(10) Patent No.: US 7,966,967 B2
(45) Date of Patent: Jun. 28, 2011

(54) ELECTROSTATIC COATING SYSTEM

(75) Inventors: Masahito Sakakibara, Okazaki (JP); Shinichi Washizu, Aichi-ken (JP); Michio Mitsui, Yokohama (JP); Kimiyoshi Nagai, Yokohama (JP)

(73) Assignees: Toyota Jidosha Kabushiki Kaisha, Toyota-shi, Aichi-ken (JP); Ransburg Industrial Finishing K.K., Kanagawa-ken (JP)

( * ) Notice: Subject to any disclaimer, the term of this patent is extended or adjusted under 35 U.S.C. 154(b) by 696 days.

(21) Appl. No.: 11/662,968

(22) PCT Filed: Sep. 16, 2005

(86) PCT No.: PCT/JP2005/018045

§ 371 (c)(1),
(2), (4) Date: Jan. 8, 2008

(87) PCT Pub. No.: WO2006/030991

PCT Pub. Date: Mar. 23, 2006

(65) Prior Publication Data

US 2008/0178802 A1 Jul. 31, 2008

(30) Foreign Application Priority Data

Sep. 17, 2004 (JP) ..... 2004-272447

(51) Int. Cl.
*B05B 5/025* (2006.01)
*B05B 3/00* (2006.01)

(52) U.S. Cl. ..... 118/628; 118/629; 118/625; 118/323; 239/706

(58) Field of Classification Search ..... 118/620–640, 118/308, 321, 323; 239/700–708
See application file for complete search history.

(56) References Cited

U.S. PATENT DOCUMENTS

| | | | | |
|---|---|---|---|---|
| 3,393,662 | A | 7/1968 | Blackwell | |
| 3,408,985 | A | 11/1968 | Sedlacsik | |
| 4,011,991 | A * | 3/1977 | Masuda | 239/708 |
| 4,532,148 | A * | 7/1985 | Vecellio | 427/480 |
| 5,163,625 | A | 11/1992 | Takayama | |
| 5,584,931 | A * | 12/1996 | Buhlmann | 118/628 |
| 2003/0001031 | A1 | 1/2003 | Heldt et al. | |

(Continued)

FOREIGN PATENT DOCUMENTS

EP 1502655 2/2005

(Continued)

OTHER PUBLICATIONS

International Search Report.

(Continued)

*Primary Examiner* — Yewebdar T Tadesse
(74) *Attorney, Agent, or Firm* — Finnegan, Henderson, Farabow, Garrett & Dunner, LLP

(57) ABSTRACT

An electrostatic coating system (1) comprising a coating gun (2) for spraying a coating material toward an article (9) to be coated, and a robot arm (3) for moving the coating gun (2) with respect to the article (9) to be coated wherein a voltage is applied to the coating gun (2). A needle-like electrode (11) which is an electrostatic electrode having a pointed end applied with a voltage having the same polarity as that of the voltage applied to the coating gun (2), is attached to the coating gun (2) or the robot arm (3).

5 Claims, 8 Drawing Sheets

U.S. PATENT DOCUMENTS

2004/0061007 A1* 4/2004 Milojevic et al. ..... 239/690

FOREIGN PATENT DOCUMENTS

| | | |
|---|---|---|
| FR | 1370305 | 7/1964 |
| GB | 1037978 | 8/1966 |
| JP | S34-19761 | 12/1959 |
| JP | 52-043846 | 4/1977 |
| JP | 55-092159 | 7/1980 |
| JP | 06-142561 | 5/1994 |
| JP | 09-085133 | 3/1997 |
| JP | 10-57848 | 3/1998 |

OTHER PUBLICATIONS

Search report issued by EPO on Jun. 18, 2009, in application EPO No. 05 78 8144.

English translation of International Preliminary Report on Patentability for PCT/JP2005/018045, filed Sep. 16, 2005.

* cited by examiner

ELECTROSTATIC COATING SYSTEM

TECHNICAL FIELD

This invention relates to the electrostatic painting equipment which performs an electrostatic painting, especially relates to the technology for preventing the adhesion dirt of spraying mist generated on a paint gun or a robot arm equipped with the paint gun.

BACKGROUND ART

Generally, electrostatic paint is used for the paint to a workpiece, such as a car body. Electrostatic paint makes electrostatic field between the workpiece side as anode and the paint equipment side as cathode, making the negatively charged atomized paint adsorb to the workpiece by electrostatic force.

As paint equipment performing such electrostatic paint, there is rotary atomizer type electrostatic paint equipment, for example. The paint equipment has a paint gun spraying paint to a workpiece and a robot arm moving the paint gun to the workpiece, rotating the bell cup of the paint gun, making fluid paint which spread on the inside of the bell cup into the state atomized with centrifugal force, charging atomized particles with the electrostatic high voltage impressed by the atomizer etc, and performing electrostatic paint by electrostatic field formed between the grounded workpieces.

This electrostatic paint equipment applies electrostatic high voltage to the metal bell cup and the electrostatic electrode at the tip of the paint gun, charging paint by putting air ions generated from discharge of them on paint, and driving charged paint to stick with the electrostatic force. For this reason, when there is something with a different electrostatic potential from the charged paint except the workpiece, the charged paint adheres to that.

In the paint equipment of rotary atomizer type, it is general to form the spray pattern, called shaping air, with assistance air that controls the form of the spray pattern. The compulsive injection from the shaping air nozzle of this shaping air forms the negative pressure domain of air in the circumference. Moreover, it may be occurred the backlash of the paint atomized by spraying towards the workpiece.

Generally, the external-ornament member of electrostatic painting equipment consists of insulating resin members, and has different electrification potential from that of the paint. Therefore, existence of these negative pressure domains and backlash of the paint, in the circumferences of the painting gun etc., generates electrostatic adhesion of the paint on the surface of resin inevitably to this external ornament member, generating stains.

For example, as shown in FIG. 9, the sprayed paint is flown along with the line of electromagnetic force m formed by bell cup 102*a* of the painting gun 102, and paints a workpiece 109. However, since the paint particle rebounded on the workpiece 109 and the paint particle floating without adhesion to the workpiece are electrified particles, they adhere to the portions with the low surface potential of electrostatic painting equipment, such as surface of the painting gun 102 which consists of resin members etc., making dirt 102*p*.

And since electrostatic attraction becomes so strong that the distance of charged paint and a workpiece is near, the dirt will grow from the tip part of the painting gun 102 near the bell cup 102*a*.

Thus, the dirt by adhesion of the atomized paint is a serious problem in the process of painting. That is, if the produced dirt becomes remarkable, the dirt paint will make a spit, adhering to a workpiece, and generating the poor result of painting.

And, although the produced dirt is cleaned in order to prevent poor generating, a painting line stops in this cleaning time. Therefore, when the frequency of cleaning increases, troubles will be largely caused to the painting quantity of production. For the automobile production line which produces the large-sized product under the short baton especially, increase of stopping time in a production line is a very big problem, and it is an important subject constituting the painting equipment which hardly becomes dirty.

Then, conventionally, the electrostatic panel impressed to the same voltage as the painting gun is attached in a painting gun or a robot arm, and the painting gun of the atomized paint and adhesion on a robot arm are reduced by the electrostatic restitution of an electrostatic panel(For example, JPH06-142561, A).

For example, as shown in FIG. 10, in the electrostatic painting equipment 101 with the robot arm 103 supporting the painting gun 102 movably, the electrostatic panel 104 is attached in the basis end of the painting gun 102, making paint mist go to the workpiece side and not to approach the painting gun 102 and the robot arm 103 side by the electrostatic restitution of the electrostatic panel 104.

As mentioned above, it is available to prevent adhesion of the paint mist to the painting gun and the robot arm 103 by causing the repulsion of the paint mist with attaching the electrostatic panel that is impressed the same polar voltage as the painting gun to the electrostatic painting equipment.

However, the electrostatic panel has only a front side in the electrostatic repulsion direction to paint. For example, on occasions when the painting gun 102 moves quickly after injecting the paint as shown in FIG. 11, the paint mist which floats out of the range of the electrostatic restitution of the electrostatic panel 104 will turn to the back side of the electrostatic panel 104, and will adhere to the robot arm 103 etc. Therefore, the dirt cannot be prevented completely. In this case, in order to prevent adhesion of the paint to the robot arm 103 etc., it is necessary to restrict the speed of the robot arm 103 of operation etc., and it affects on the productivity etc.

DISCLOSURE OF INVENTION

The electrostatic painting equipment which solves the above-mentioned subject has the following features.

That is, in this invention, electrostatic painting equipment comprises a painting gun spraying paint to a workpiece; a robot arm moving the painting gun, wherein the painting gun is impressed voltage; and needlelike electrostatic electrodes arranged in the shape of radiation towards outside and are attached to either the painting gun or the robot arm at least, wherein the needlelike electrostatic electrodes are impressed the same polar voltage as the painting gun and the needlelike electrostatic electrode has one or more tip part.

Thereby an electrostatic field is formed also in the circumference of the attached electrostatic electrode, and the paint mist fly to the workpiece side by the electrostatic electrode, being prevented adhering to the painting gun or the robot arm.

Since especially the electrostatic electrode has the tip part, it forms a powerful electrostatic field and a high effect preventing the dirt of paint adhesion.

And, since the same polar voltage is impressed to the painting gun and the electrostatic electrode, a continuous and homogeneous barrier of electric field is formed over the large range. And it prevents flying the paint mist to the side of electrostatic painting equipment, and reduces effectively the dirt by adhesion of the paint to the painting gun and the robot arm.

And, this invention uses a needlelike electrode in the electrostatic electrode.

Thus, the electrostatic field formed with the needlelike electrostatic electrode is formed not only a front side (i.e. workpiece side), formed by the conventional electrostatic panel in electrostatic painting equipment, but in the shape of radiation. When the painting gun moves quickly by the robot arm, painting mist is flipped by electrostatic power and the dirt of paint adhesion is prevented.

And, the electric discharge on the electrostatic electrode, which has a potential setting fire, is prevented by making small energy (electrostatic capacity) held in an electrostatic supply course which comprises an electrostatic electrode, a high-voltage generator for impressing the high voltage to the electrostatic electrode, and a high-voltage cable, etc.

And, this invention constitutes the electrostatic electrode movable to a painting gun or a robot arm.

Thereby, according to a spraying pattern of paint from the painting gun, a locus of the robot arm of operation, a range of operation etc., the position at the tip of the electrostatic electrode to the painting gun and the robot arm is adjusted, and the electrostatic repulsion effect is increased.

And, in this invention, the electrode consists of a ring member arranged to surround the circumference of the painting gun and/or the robot arm, and the ring member has one or more tip edge.

Thereby, in the circumference of the painting gun and the robot arm, powerful electrostatic field is continuously formed by the ring shape electrode with the tip edge, and it increases the effect of electrostatic repulsion against the paint mist.

And, in this invention, the electrode consists of a ring member and needlelike electrodes which project in the direction of outside from the ring member.

Thereby, according to the concentration of paint mist, the specification of the painting gun or the robot arm, etc., the dirt by adhesion of painting is decreased efficiently.

And, in this invention, the power supply that impresses voltage to the painting gun, and the power supply that impresses voltage to the electrostatic electrode are used as different power supply.

Thereby, the safe circuit of different system can be established in each power supply, and even on occasions when irregulars occur like that excessive current flows in one power supply circuit arise, it is available to continue the voltage impression to the power supply circuit of another side.

And, in this invention, the voltage impressed to the electrostatic electrode changes according to the distance from the bell cup of the painting gun up to the installation position of the electrostatic electrode, and the voltage is configured so that it may become smaller, as the distance from a bell cup becomes larger.

Thereby, adhesion of paint mist can be effectively prevented over the robot arm from the painting gun. Because, the paint mist charged in static electricity emit electric charge by natural electric discharge when time passes.

And, generally, solvent type paint holds an electric charge for a long time, and distemper particle emits an electric charge quickly. Therefore, it effectively prevents adhesion of paint mist to change the voltage impressed to an electrode according to whether distemper or solvent paints.

THE BEST MODE FOR CARRYING OUR THE INVENTION

Next, the embodiment for carrying out this invention is explained using an attached drawing.

Figure 1:
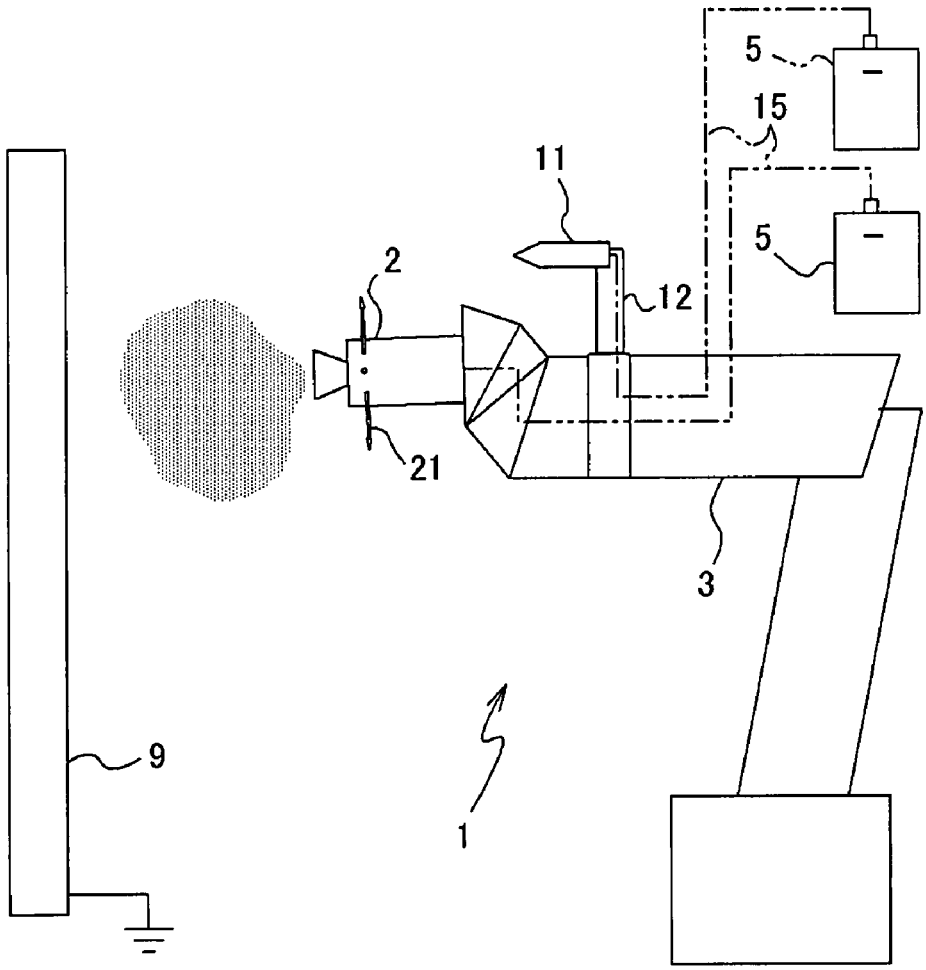
FIG. 1 is a side view showing the electrostatic painting equipment of this invention.

The electrostatic painting equipment 1 shown in FIG. 1 is equipped with the painting gun 2 which sprays paint to a workpiece 9, and the robot arm 3 to which this painting gun 2 is moved to the workpiece 9. The robot arm 3 is attached the needlelike electrode 11 that generates electrostatic repulsion against floating paint mist with the support stand 12. And, pluralities of needlelike electrodes 21 are attached in the tip portion of the painting gun 2 in the shape of radiation.

The painting gun 2 and the needlelike electrode 11 are separately connected to each high-voltage generator 5 by the high-voltage cable 15, and the high voltage of negative is impressed to the tip part of the painting gun 2 and the needlelike electrode 11.

The needlelike electrode 21 is electrically connected with the painting gun 2, being impressed in the voltage equivalent to the voltage currently impressed to the painting gun 2.

And, the voltage impressed to the needlelike electrode 11 is configured equivalent or lower (the potential difference to 0V is small) than the voltage impressed to the painting gun 2. For example, the voltage impressed to a painting gun 2 is configured as about DC minus 90 kV, and the voltage impressed to the needlelike electrode 11 is configured as DC minus 50 kV–minus 70 kV.

In this case, the voltage impressed to the needlelike electrode 21 becomes about DC minus 90 kV as well as a painting gun 2.

And, in the electrostatic painting equipment 1 shown in FIG. 1, the voltages to the painting gun 2 and the needlelike electrode 11 are impressed by the respectively different high-voltage generator 5. Therefore, safe circuits can be provided in each high-voltage generator 5 and even if an irregular case, like current excision on the one side (for example, the needlelike electrode 11), the voltage impression to another side (the painting gun 2) is kept.

In addition, it is also available to impress voltage by the common high-voltage generator 5 to the painting gun 2 and the needlelike electrode 11. In this case, if needed, two safe circuits are provided in one high-voltage generator 5, and as mentioned above, even on occasions when an irregular case arise in one side, the voltage impression to another side can be maintained.

Figure 2:
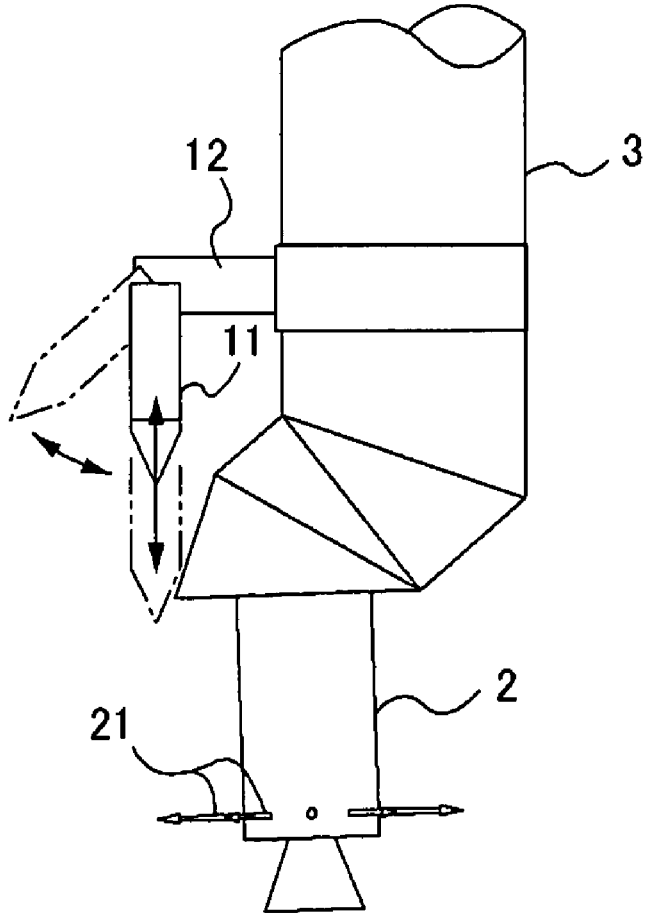
FIG. 2 is a side view showing the needlelike electrode attached to the robot arm.

As shown in FIG. 2, the needlelike electrode 11 is constituted free to the support stand 12 in rotation, expansion and contraction.

Figure 3:
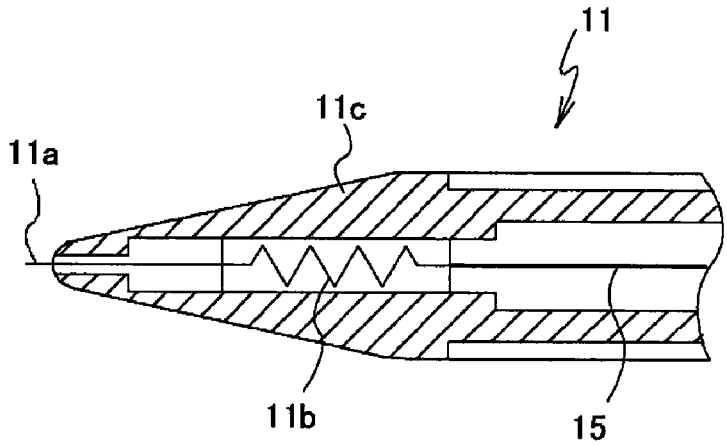
FIG. 3 is a side sectional view showing the structure of the needlelike electrode.

And, as shown in FIG. 3, the needlelike electrode 11 consists of the electrode needle 11*a* covered by the insulated case 11*c*, the electrode needle 11*a* is connected to the high-voltage cable 15 through the resistor 11*b*.

In this case, since electrode needle 11*a* which is a needlelike member as an electrode is used, the energy (electrostatic capacity) held for electrostatic supply courses, such as the high-voltage generator 5 and the high-voltage cable 15, comes to become small. It has prevented ignition of electric discharge arising from the tip of the electrode needle 11*a*. Furthermore, since the resistance of the resistor 11*b* is configured as high resistance like 5-300 M ohm, ignition of electric discharge can be suppressed more certainly.

And, the insulated case 11*c* and the support stand 12 are constituted using the member equipped with high water repellence, such as PTFE (Poly Tetra-Fluoro Ethylene).

In such electrostatic painting equipment 1, the paint injected from the painting gun 2 is applied to the workpiece 9 by the electrostatic field which formed from the painting gun 2 impressed with the negative high voltage to the grounded workpiece 9. However, the high voltage of negative is impressed to the needlelike electrode 11 as well as the painting gun 2. Therefore, an electrostatic field is formed also in the circumference of the needlelike electrode 11, the paint mist floating around the needlelike electrode 11 is flown to the workpiece 9 side by electrostatic repulsion, and the adhesion on the robot arm 3 is prevented.

Since especially the needlelike electrode 11 formed in the shape of a tip (point) can form a powerful electrostatic field, a high effect is in the dirt prevention by adhesion of paint.

And, since they are formed not only a front side (workpiece side), which is shown in a conventional electrostatic panel, but in the shape of radiation, even when the robot arm 3 moves quickly, dirt of painting adhesion can be prevented by electrostatic repulsion against painting mist.

Figure 4:
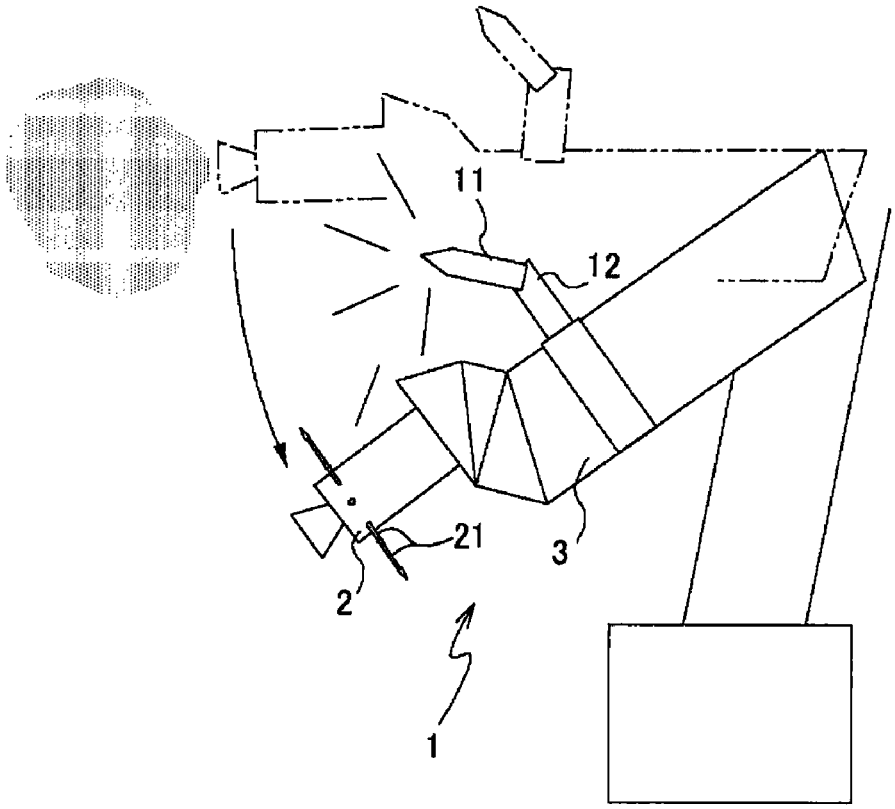
FIG. 4 is a drawing showing the state of electrostatic repulsion of the paint mist by the needlelike electrode when the robot arm moves quickly.

As shown in FIG. 4, the electrostatic field by the needlelike electrode 11 is formed broadly (formed in the shape of radiation from the electrode needle 11*a* which is tip part of the needlelike electrode 11). Therefore, even on occasions when it moves quickly after the painting gun 2 injected the paint, the floating paint mist is flown to the workpiece 9 side by the electrostatic field formed broadly. And the adhesion to the robot arm 3 of paint mist etc. is prevented, and generating of dirt can be reduced.

The needlelike electrode 11 is constituted free to the robot arm 3 in rotation, expansion and contraction, according to the movement locus and the movement range, etc. of the robot arm 3, the position of electrode needle 11*a* at the needlelike electrode 11 tip to the robot arm 3 can be adjusted and the electrostatic repulsion effect can be increased.

In addition, electrostatic paint equipment 1 can be equipped with one or more needlelike electrodes 11. And it is also possible to arrange the needlelike electrode 11 in other parts, such as not only the robot arm 3 but the paint gun 2.

Figure 5:
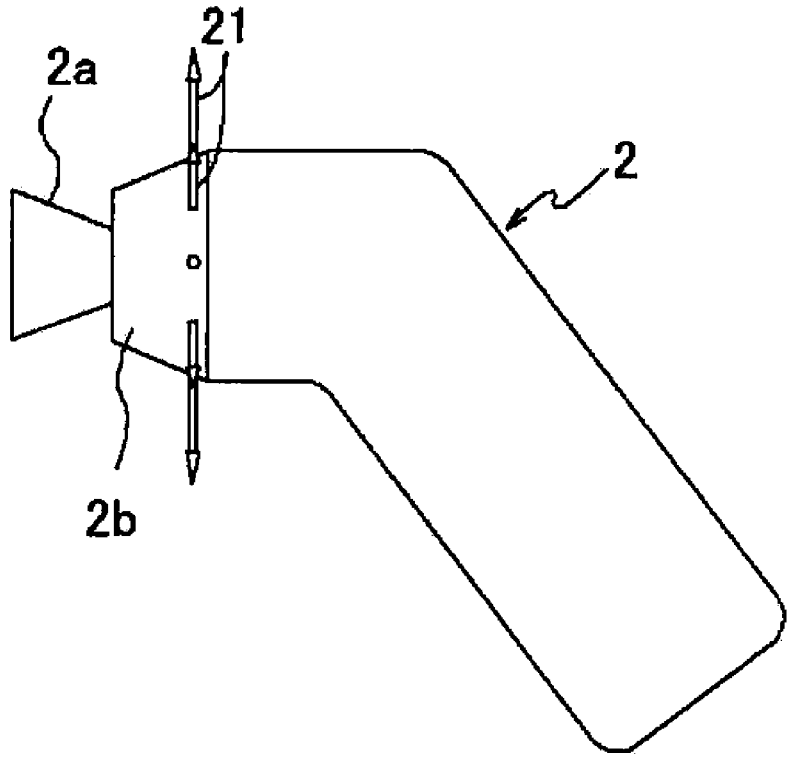
FIG. 5 is a side view showing the second embodiment of an electrostatic electrode.

Moreover, as shown in FIG. 5, the bell cup 2*a* and shaping air ring 2*b*, which are formed in metal member and voltage from said high-voltage generator 5 is applied, are arranged at the front part of the paint gun 2. And a plurality of said needlelike electrodes 21 for the paint gun 2 are attached in the perimeter part of shaping air ring 2*b* located behind bell cup 2*a*. For example, pluralities of needlelike electrodes 21 are arranged in the shape of radiation towards outward of the radius direction. Moreover, the needlelike electrode 21 arranged in the shape of radiation can take the arrangement that made it incline just beside not only toward arrangement of a direction but toward the front (the direction of bell cup 2*a*), and the arrangement made to incline toward back, as shown in FIG. 5.

Figure 6:
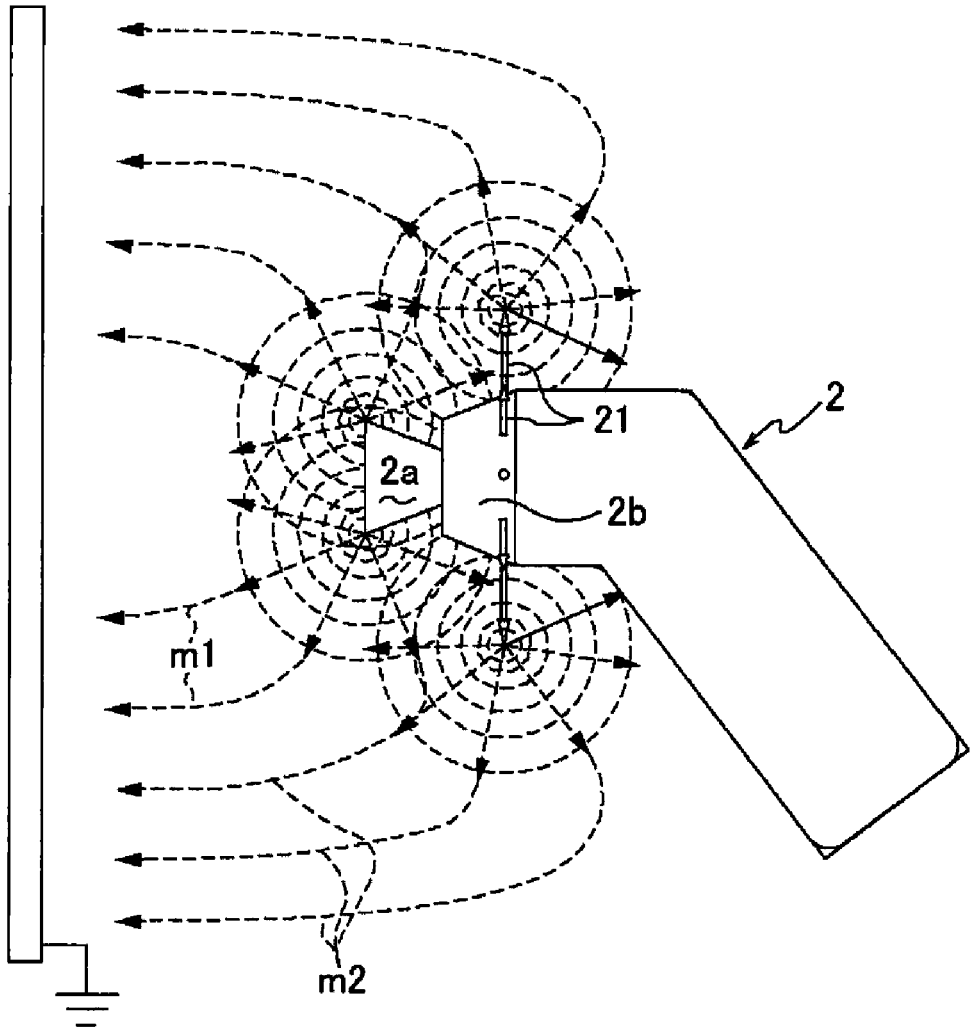
FIG. 6 is a side view showing the line of electromagnetic force of the painting gun with the electrostatic electrode shown in FIG. 5.

Since the needlelike electrode 21 is formed in the paint gun 2, the electromagnetic force line near the tip part of the paint gun 2 consists of an electromagnetic force line m1 which bell cup 2*a* forms, and an electromagnetic force line m2 which the needlelike electrode 21 forms shown in FIG. 6. And the electric-field barrier that repels paint mist by electrostatic force is formed in the large area near the tip part of the paint gun 2.

And behind the bell cup 2*a*, the negative pressure zone is caused by rotation of the bell cup 2*a*. However, the electric-field barrier formed by the electromagnetic force line m2 of the needlelike electrode 21 can reduce the adhesion dirt of the paint mist to the paint gun 2 generated by forming this negative pressure zone.

In addition, it is possible to prevent the adhesion dirt of paint mist, without disturbing the spraying pattern of the paint sprayed from the paint gun 2 by setting up the length of the needlelike electrode 21 short at low-speed rotation of bell cup 2*a*, and setting it up long at high-speed rotation.

Moreover, the needlelike electrode 21 can be attached in portions other than paint gun 2, such as the robot arm 3.

Moreover, the electrostatic electrode that repels the floating paint mist by electrostatic force can be constituted as follows.

Figure 7:
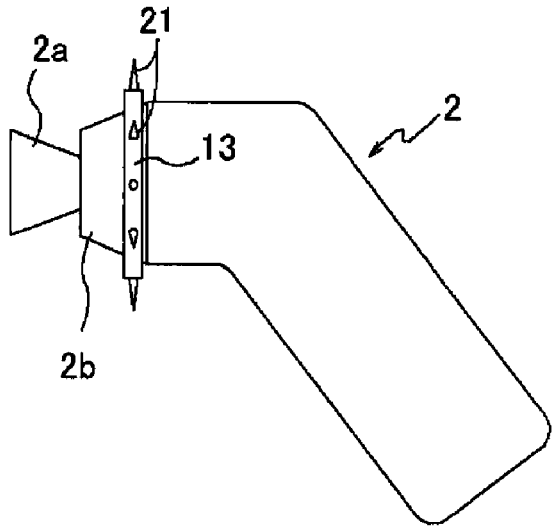
FIG. 7 is a side view showing the third embodiment of the electrostatic electrode.
Figure 8:
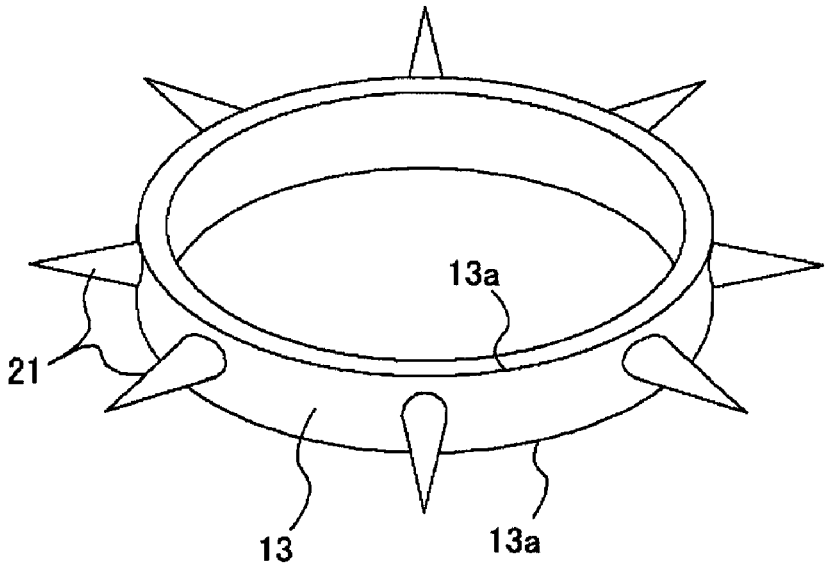
FIG. 8 is a perspective view showing the electrostatic electrode of the third embodiment which consists of a ring electrode and needlelike electrodes.
Figure 9:
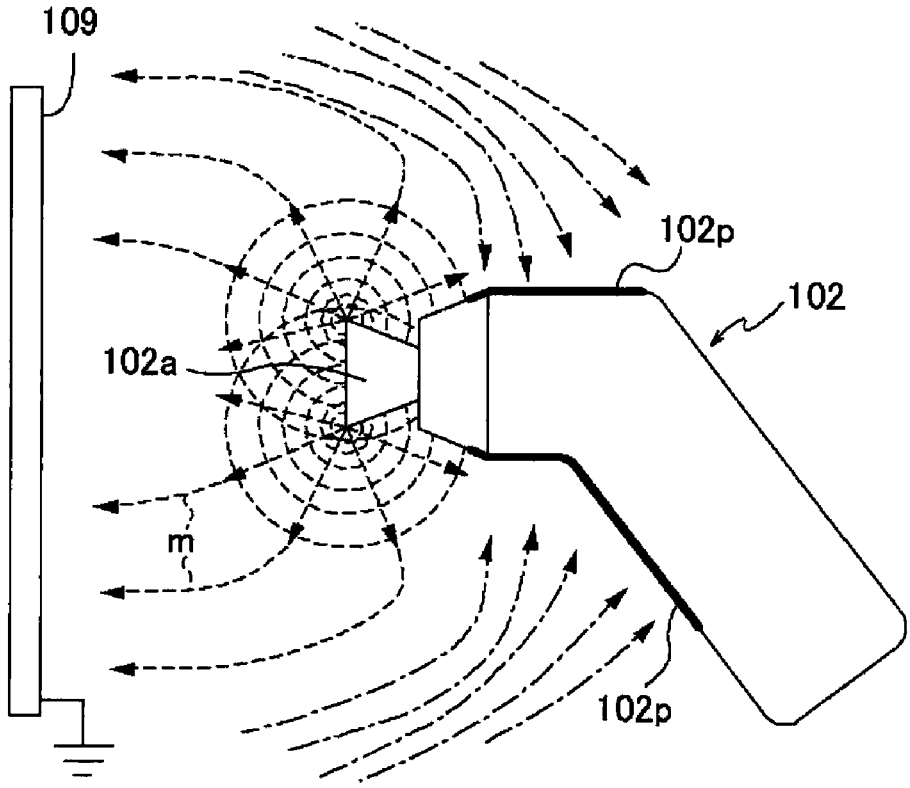
FIG. 9 is a side view showing the line of electromagnetic force of the painting gun in conventional electrostatic painting equipment.
Figure 10:
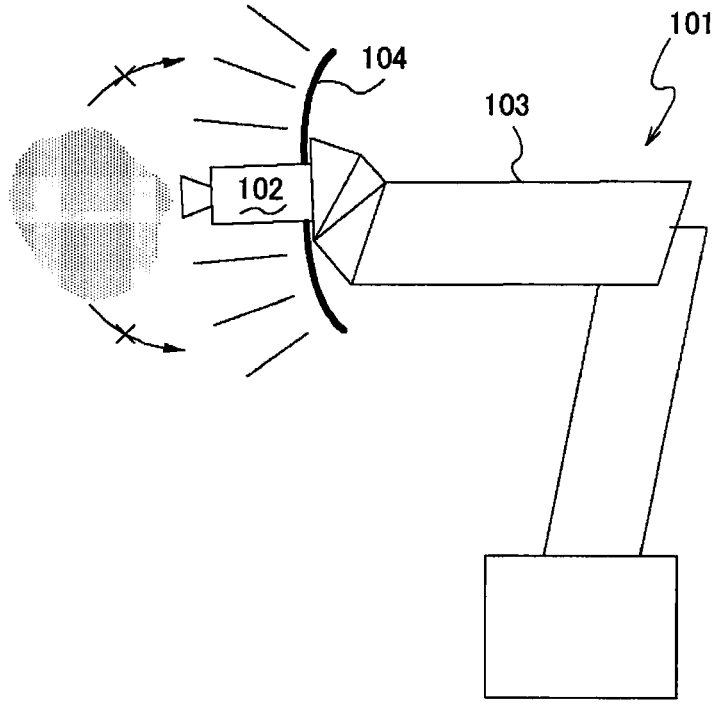
FIG. 10 is a side view showing the conventional electrostatic painting equipment which attached an electrostatic panel.
Figure 11:
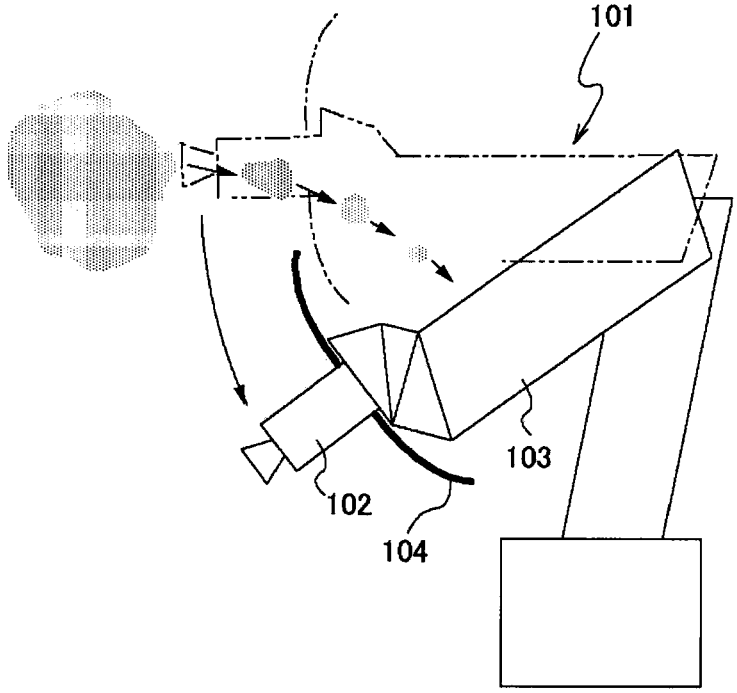
FIG. 11 is a side view showing the state where paint mist adheres to electrostatic painting equipment, on occasions when a robot arm moves quickly in the conventional electrostatic painting equipment which attached the electrostatic panel.

That is, it sets to the paint gun 2 shown in FIG. 7 and FIG. 8, electrostatic electrodes can consist of the ring electrode 13 that is arranged at the perimeter part of shaping air ring 2*b* located behind bell cup 2*a* and formed in a circle and plural needlelike electrodes 21 that installed in the shape of radiation towards outward of the radius direction from the perimeter side of the ring electrode 13. The negative high voltage is applied to this ring electrode 13 and needlelike electrode 21 both.

The ring electrode 13 is equipped on the vertical side, in FIG. 8, with tip edge 13*a*, and forms the electrostatic field centering on the tip edge 13*a*.

The electric-field barrier that consists of the electrostatic field by bell cup 2*a*, the electrostatic field by tip edge 13*a* of the ring electrode 13 arranged behind bell cup 2*a*, and the electrostatic field by tip edge 13*a* of the ring electrode 13 arranged behind bell cup 2*a* is formed in the large area near the tip part of the paint gun 2, and the electric-field barrier by needlelike electrode 21 which projects in the perimeter part of the ring electrode 13, and the electric-field barrier repels paint mist by electrostatic force like the case shown in the above-mentioned FIG. 6.

By the electric-field barrier formed around this paint gun 2, the floating wide range paint mist flies to the workpiece 9 side, and reduces the dirt by adhesion of the paint to the paint gun 2.

Especially, the powerful electrostatic field by the ring electrode 13 equipped with tip edge 13*a* is continuously formed in the circumference of the paint gun 2.

For this reason, it is possible to increase the electrostatic repulsion effect against paint mist.

In addition, the section form of the ring electrode 13 in FIG. 8 is formed in square form. However, form is not restricted to this, the shape of the shape of a triangle or a polygon etc. can be used. What is necessary for the form is just form equipped with tip form (sharp edge).

Moreover, the needlelike electrode 21 which projects from the ring electrode 13 reduces the dirt by adhesion of paint efficiently by installing the quantity according to the concentration and the paint gun 2 of paint mist, the specification of the robot arm 3, etc. The form of the needlelike electrode 21 should just be form equipped with tip form (sharp edge), the form divided into two or more is sufficient as a tip. Furthermore, what stuck a brush of electric conduction on the perimeter side of the ring electrode 13 is also usable.

In addition, it is possible to forms only the ring electrode 13 without the needlelike electrode 21 for the specification of this electrostatic paint equipment 1 etc.

Moreover, in this electrostatic paint equipment 1, voltage of the same degree is applied to the paint gun 2 (bell cup 2*a*), and the ring electrode 13 and the needlelike electrode 21. For this reason, a continuous and homogeneous electric-field barrier can be formed over the large range, it prevents flying of the paint mist to the side of electrostatic paint equipment 1, and the dirt of the paint gun 2 by adhesion of the paint can be reduced effectively.

In addition, in this embodiment, the ring electrode 13 and the needlelike electrode 21 are arranged in the perimeter part of shaping air ring 2*b*. However, what is necessary is not to be restricted to these arrangements but just to arrange in the place that can prevent that the paint mist flies to the electrostatic paint equipment 1 side.

Moreover, the paint mist of near the bell cup 2*a* just sprayed from the paint gun 2 is charged on voltage equivalent to the bell cup 2*a*. For this reason, it repels effectively with the needlelike electrode 21 with which the same voltage as bell cup 2*a* is applied.

On the other hand, paint mist that sprayed from paint gun 2 and exists in robot arm 3 that is distant from bell cup 2*a* by progress of time is charged at voltage lower than the voltage currently applied to bell cup 2*a* (the potential difference to 0V is small). The voltage applied to the needlelike electrode 11 attached in the robot arm 3 is set up so that it may become voltage of the same degree as about robot arm 3 paint mist (namely, voltage lower than the voltage currently applied to bell cup 2*a*). Thereby, the repulsion to the paint mist by the needlelike electrode 11 can be used effectively.

Thus, the voltage impressed to the needlelike electrode 11 and 21 is regulated according to the electrification voltage of the paint mist which floats near the arrangement position of the needlelike electrode 11 and 21. This prevents effectively adhesion of the paint mist ranging from the painting gun 2 to the robot arm 3.

And, it is also available to provide either the needlelike electrode 11 or the needlelike electrode 21 in the painting gun 2 and the robot arm 3 according to the floating situation of the paint mist to the painting gun 2 and the robot arm 3.

INDUSTRIAL APPLICABILITY

This invention is suitable for using for the electrostatic painting equipment which performs an electrostatic painting.

What is claimed is:

1. Electrostatic painting equipment comprising:

a painting gun spraying paint to a workpiece;

a robot arm moving the painting gun, wherein the painting gun is impressed by voltage;

a plurality of first needle electrostatic electrodes attached to the painting gun and projecting radially outward from the painting gun; and a second needle electrostatic electrode attached to the painting gun or the robot arm via a support stand and configured to have both rotational movement and translational movement with respect to the support stand, wherein the plurality of first needle electrostatic electrodes are impressed by the same polar voltage as the painting gun and each of the plurality of first needle electrostatic electrodes has at least one tip part.

2. Electrostatic painting equipment as claimed in claim 1, further comprising a ring electrostatic electrode, the ring electrostatic electrode comprising a ring member arranged to surround the painting gun or the robot arm, said ring member having one or more tip edges.

3. Electrostatic painting equipment as claimed in claim 1, further comprising a ring electrostatic electrode, the ring electrostatic electrode comprising a ring member arranged to surround the painting gun or the robot arm and the plurality of first needle electrostatic electrodes projecting radially outward from an outer face of the ring member.

4. Electrostatic painting equipment as in claims 1, 2 or 3, further comprising:

a first power supply impressing voltage to the painting gun; and a second power supply impressing voltage to the second needle electrostatic electrode.

5. Electrostatic painting equipment as in claims 1, 2 or 3, in which the voltage impressed to the second needle electrostatic electrode is configured according to the distance from a bell cup of the painting gun to the position of the second needle electrostatic electrode, wherein the voltage impressed to the second needle electrostatic electrode becomes small as the distance from the bell cup to the position of the second needle electrostatic electrode becomes large.

* * * * *